US009038316B2

(12) United States Patent
Von Gerichten

(10) Patent No.: US 9,038,316 B2
(45) Date of Patent: May 26, 2015

(54) METHOD BY WHICH EXISTING MOTORIZED COMMERCIAL AUTOMATIC SLIDING DOOR SYSTEMS CAN BE ADAPTED FOR USE ON NEW OR EXISTING RESIDENTIAL (PATIO) SLIDING GLASS OR SLIDING SCREEN DOORS

(76) Inventor: Richard Von Gerichten, Ocean, NJ (US)

( * ) Notice: Subject to any disclaimer, the term of this patent is extended or adjusted under 35 U.S.C. 154(b) by 1917 days.

(21) Appl. No.: 12/283,675

(22) Filed: Sep. 15, 2008

(65) Prior Publication Data

US 2009/0077898 A1 Mar. 26, 2009

Related U.S. Application Data

(60) Provisional application No. 60/995,084, filed on Sep. 25, 2007.

(51) Int. Cl.
*E05F 11/00* (2006.01)
*E05D 15/06* (2006.01)

(52) U.S. Cl.
CPC ..... *E05D 15/063* (2013.01); *E05Y 2201/614* (2013.01); *E05Y 2600/31* (2013.01); *E05Y 2600/626* (2013.01); *E05Y 2900/136* (2013.01)

(58) Field of Classification Search
CPC ..... E05D 15/063; E05Y 2600/31; E05Y 2600/626; E05Y 2201/614; E05Y 2900/136
USPC ..... 49/409, 410, 425, 360, 506
See application file for complete search history.

(56) References Cited

U.S. PATENT DOCUMENTS

| | | | | |
|---|---|---|---|---|
| 629,165 | A * | 7/1899 | Larson | 16/96 R |
| 3,425,162 | A * | 2/1969 | Halpern | 49/425 |
| 3,890,744 | A | 6/1975 | Galis | |
| 4,099,599 | A * | 7/1978 | Randall | 187/313 |
| 4,149,615 | A * | 4/1979 | Kappenhagen | 187/324 |
| 4,288,887 | A * | 9/1981 | Johnson et al. | 16/105 |
| 4,893,435 | A | 1/1990 | Shalit | |
| 5,325,628 | A | 7/1994 | Yingling | |
| 5,622,007 | A | 4/1997 | Archer | |
| 5,625,266 | A | 4/1997 | Stark | |
| 5,634,298 | A | 6/1997 | Slopack | |
| 6,698,138 | B1 * | 3/2004 | Lin | 49/409 |
| 6,962,239 | B2 | 11/2005 | Shikai et al. | |

FOREIGN PATENT DOCUMENTS

FR 2631072 A1 * 11/1989 ..... E05D 15/06

* cited by examiner

*Primary Examiner* — Jerry Redman
(74) *Attorney, Agent, or Firm* — Occhiuti & Rohlicek LLP

(57) ABSTRACT

An automatic patio sliding door for residential (home) use is created using an existing motorized automatic system which is now in use in commercial, industrial, and public building entrances. A method incorporating a bracket system is used to apply the commercial (hanging track type) automatic door system to existing residential patio sliding doors or to new patio sliding doors. The purpose is to provide hands free opening and closing of patio glass or screen doors (single or double panels). This allows for ease of use of sliding doors when hands are full, guarantees the closing of screen doors or glass doors behind the person to prevent insects getting into the house or loss of air conditioning in the house, and provides an easy access door system in the home for the physically handicapped.

1 Claim, 10 Drawing Sheets

PRIOR ART

METHOD BY WHICH EXISTING MOTORIZED COMMERCIAL AUTOMATIC SLIDING DOOR SYSTEMS CAN BE ADAPTED FOR USE ON NEW OR EXISTING RESIDENTIAL (PATIO) SLIDING GLASS OR SLIDING SCREEN DOORS

RELATED U.S. APPLICATION DATA

Provisional patent application No. 60/995,084 with filing date Sep. 25, 2007

REFERENCES CITED

U.S. Patent Documents

U.S. Pat. No. 3,890,744 issued to Gallis on Jun. 24, 1975
U.S. Pat. No. 4,893,435 issued to Shalit on Jan. 16, 1990
U.S. Pat. No. 5,325,628 issued to Yingling on Jul. 5, 1994
U.S. Pat. No. 5,622,007 issued to Archer on Apr. 22, 1997
U.S. Pat. No. 5,625,266 issued to Stark on Apr. 29, 1997
U.S. Pat. No. 5,634,298 issued to Slopack on Jun. 3, 1997
U.S. Pat. No. 6,962,239 issued to Shikaion on Nov. 8, 2005

BACKGROUND OF THE INVENTION AND PRESENT TECHNOLOGY USAGE

Today, many large stores, small convenience stores, airports, hospitals, and other publicly used front entrances employ the use of automatic electrically motorized sliding (usually metal and glass) doors. These doors can be of single door, biparting double doors on a single track, and biparting double doors on an overlapping track types. These tracks are above the doors and the doors hang down from these tracks. The tracks are part of the automatic door system assembly which means that first the automatic door system is installed and then the doors are hung from these automatic door systems.

The commercial automatic door systems are therefore strong and can overcome the inertia and move the doors using an electrical motor. The doors are fastened to the automatic system via hanging brackets. These brackets are connected to wheeled devices which run along the overhead track. A belt is used to bring the motor drive force to the wheeled devices and allows the door(s) to be pushed or pulled open or closed.

These commercial automatic door systems have now become very reliable and safe. The use of a microcontroller has done this. The system can sense the end of the door travel for both opening and closing, thus always re-adjusting itself. It can also sense when it hits an object or person and can stop and back off. What is also available; and which makes this product even more desirable for use in the home, is that these systems can use infrared motion detectors to determine automatically when to open and when to close the door(s).

With such systems available today, the use of such automation seems natural for use in the private residential home, especially the patio or deck sliding door entrance. Many homes make use of glass sliding doors which also include a sliding screen door. Other homes use the non-sliding type door (also called atrium door) but even with this type of door, a sliding screen door is also used.

The home residential market in the United States today expects usage of automatic garage door openers in nearly 100% of the homes. If the technology is available, the demand for the convenience of automatic patio doors appears likely. Advantages include the ability to have the doors open automatically while your hands are full, making sure the screen door is shut behind you, or making sure the glass door is shut behind you to keep heat or air-conditioning from escaping. This system is also good for the disabled.

There have already been a number of solutions for automation of the residential sliding door suggested such as U.S. Pat. No. 3,890,744 issued to Gallis, U.S. Pat. No. 4,893,435 issued to Shalit, U.S. Pat. No. 5,325,628 issued to Yingling, U.S. Pat. No. 5,622,007 issued to Archer, and U.S. Pat. No. 5,634,298 issued to Slopack. The claims made for these solutions include lower cost, ability to be retrofitted to existing residential sliding doors, and certain automatic features.

The goal of the claim of this disclosure is to make use of the more readily available existing automatic door systems used in commercial buildings today. The advantage of using existing commercial building products is their proven quality and reliability over decades. These commercial building type automatic door systems also incorporate the latest in sensor technology and safety features including infrared broken beam safety opening and pressure sensitive safety opening of the doors. These systems include automatic door opening and closing positioning calibration every time the unit is turned on which is perfect for the residential home owner who would be switching this automatic door system on and off daily.

SUMMARY OF THE METHOD AND USAGE

In order to provide simple and inexpensive installation in the home, the existing commercial auto door systems need to be able to be mounted on the inside or outside wall just above the existing home sliding door(s). It is desired that the existing sliding doors not be changed in any way, except for the attachment of brackets, because they are already providing environmental sealing and security (able to be locked when desired).

This method allows for the direct application and operation of a commercial (hanging track) automatic door system to an existing home patio sliding door and provides the mechanical connection to the sliding door(s) from the hanging track type automatic door system which is attached to the above wall (header) of the sliding door.

This method allows for the mounting (bolting) of the commercial track type of automatic door system simply to the wall (header) just above the existing (or just installed) sliding patio door. The commercial automatic door system comes in various sizes and lengths. The requirement here for length is that there is enough length of the internal belt or chain such that, when attached to the sliding door(s) with the brackets described by this method, the door(s) is able to achieve its full length of travel.

The commercial type automatic door systems used here require A-C electrical power. For best appearance and proper electrical code conformity, this method recommends the electrical power come from an electrical line which is within the residential wall and be connected pursuant to governing electrical code directly to the commercial automatic door unit through a wall switch. A-C power lines are usually available in the residential wall near the patio door because electrical codes normally require electrical lighting adjacent to a door leading outside the house. It is recommended that a wall switch be used to turn ON and OFF the power to the automatic door system. Such a wall switch provides instant access for turning off the power in case of a problem. It also makes it a normal daily routine to turn off the power and to manually lock the sliding door for the night or when leaving the house.

This method for use of commercial type automatic sliding door systems on home patio sliding doors provides for the transfer of the moving force of the belt or chain system of the auto door system from the unit mounted on the wall above the patio door to the sliding patio door panel (or panels) without loss of any of the automatic features of the commercial automatic sliding door system or the existing sliding patio door system. The force and power from the belt or chain is carried from the wheel carriages (which are part of the commercial automatic system) to the top of the front of the patio sliding door panel through a set of brackets which are adjustable for door size and position.

The method includes an adjustable bracket system consisting of two pieces (brackets) of strong plastic or metal or other non-bending construction material. Each piece (bracket) is L-shaped with 2 holes and 2 slotted holes. The TOP bracket has the 2 slotted holes located to match existing screw locations on the existing wheel carriage of the commercial automatic door system. These are slotted holes to allow for margin in locating the up-down position for the bracket. The other 2 holes of this bracket are for connection to the second (BOTTOM) bracket.

The BOTTOM bracket has the 2 slotted holes located to match the 2 holes of the TOP bracket. The holes are slotted to allow for margin in locating the horizontal positioning (or distance from the commercial automatic door wheel carriage to the sliding door panel). The 2 holes are for screwing the bracket directly to the sliding door. Wood screws can be used for the frames of glass doors, and machine screws with nuts and washers are recommended for attachment to the metal frame of a screen door. The two brackets comprising this bracket system can be connected together via machine screws and nuts and washers, or with pull-apart connectors, which fit into the holes, for easy disconnect.

This method includes all variations and sizes of a bracket system which is used to connect the existing vertical portion of any wheel chassis of a commercial automatic door system to a patio sliding door system. The actual sizes of the brackets can be almost anything with the most important consideration being aesthetics. It has been found that it is possible to use only one bracket system attached to only one point on the door and one point on the power drive belt (only one wheel carriage). However, there is some instability in motion of the sliding door, and it is almost impossible to have good results with only one bracket system for use on a screen door.

This method can use either two or one wide bracket system for connection to the wheel carriages of the commercial automatic door system. However, only one of these wheel carriages of the commercial automatic door system needs to be directly connected to the drive belt. The other wheel carriage can be just running on the track of the commercial automatic door system for stability. When connecting to two (2) doors which pull apart to open (travel in opposite directions), another complete set of brackets is needed for connecting the second door panel to the existing second set of wheel carriages of the commercial automatic door system which are connected to the belt which travels in the opposite direction. (This should already exist when using the appropriate commercial automatic door system for a two sliding door system.)

The BOTTOM bracket has the 2 slotted holes located to match the 2 holes of the TOP bracket. The holes are slotted to allow for margin in locating the horizontal positioning (or distance from the commercial automatic door existing bracket to the door). The 2 holes are for screwing the bracket directly to the sliding door. Wood screws can be used for the frames of glass doors, and machine screws with nuts and washers are recommended for attachment to the metal frame of a screen door. The two brackets comprising this invention (bracket system) can be connected together via machine screws and nuts and washers, or with pull-apart connectors, which fit into the holes, for easy disconnect.

Embodiments of the invention include all variations and sizes of a bracket system used to connect the existing vertical portion of any bracket of a commercial automatic door system to a patio sliding door system.

The actual sizes of the brackets can be almost anything with the most important consideration being aesthetics. It has been found that it is possible to use only one bracket system (the invention) attached to only one point on the door and one point on the power drive belt. However, there is some instability in motion of the sliding door, and it is almost impossible to have good results with only one bracket system for use on a screen door.

Figure 3:
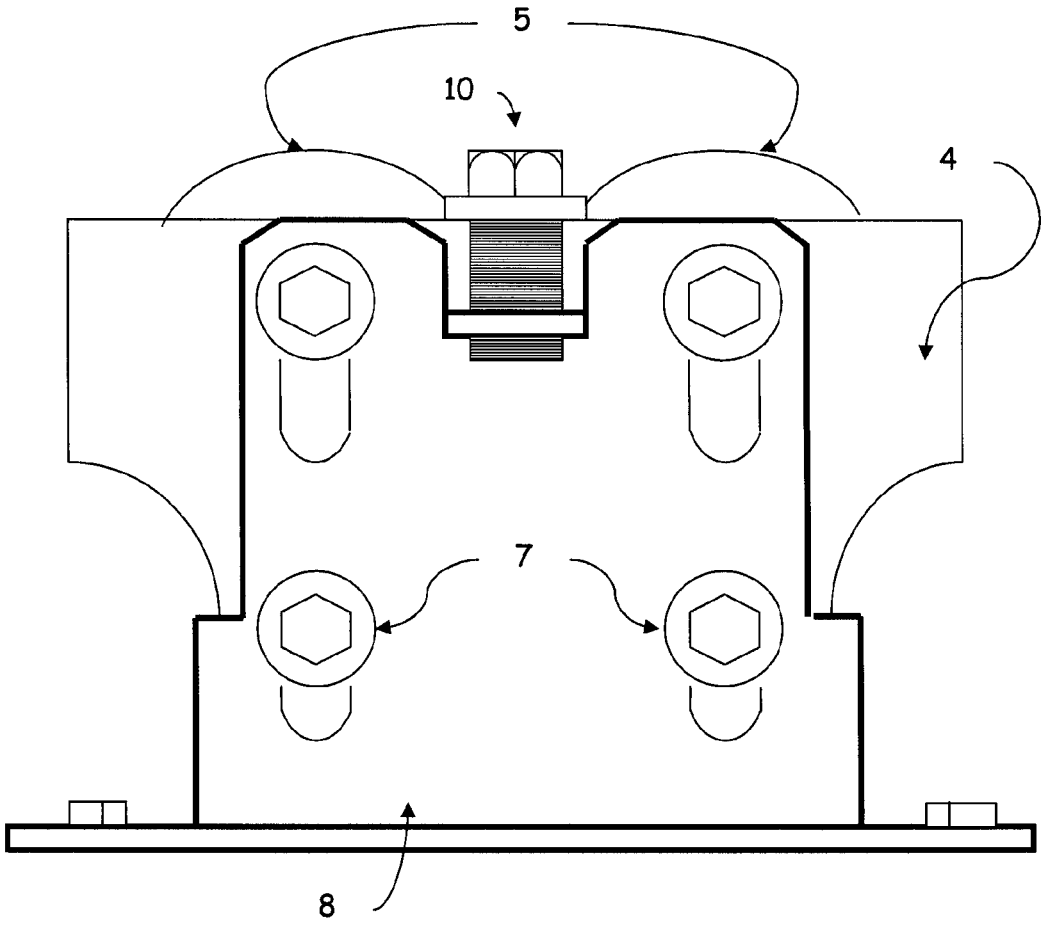
FIG. 3 is a front view of one of the wheel carriages which are part of a commercial automatic door system. The figure shows the L bracket that is attached to the side of the wheel carriage (the side parallel to the track) which comes with the wheel carriage and allows the commercial sliding door panel to be attached and to hang directly below the wheel carriage.
Figure 4:
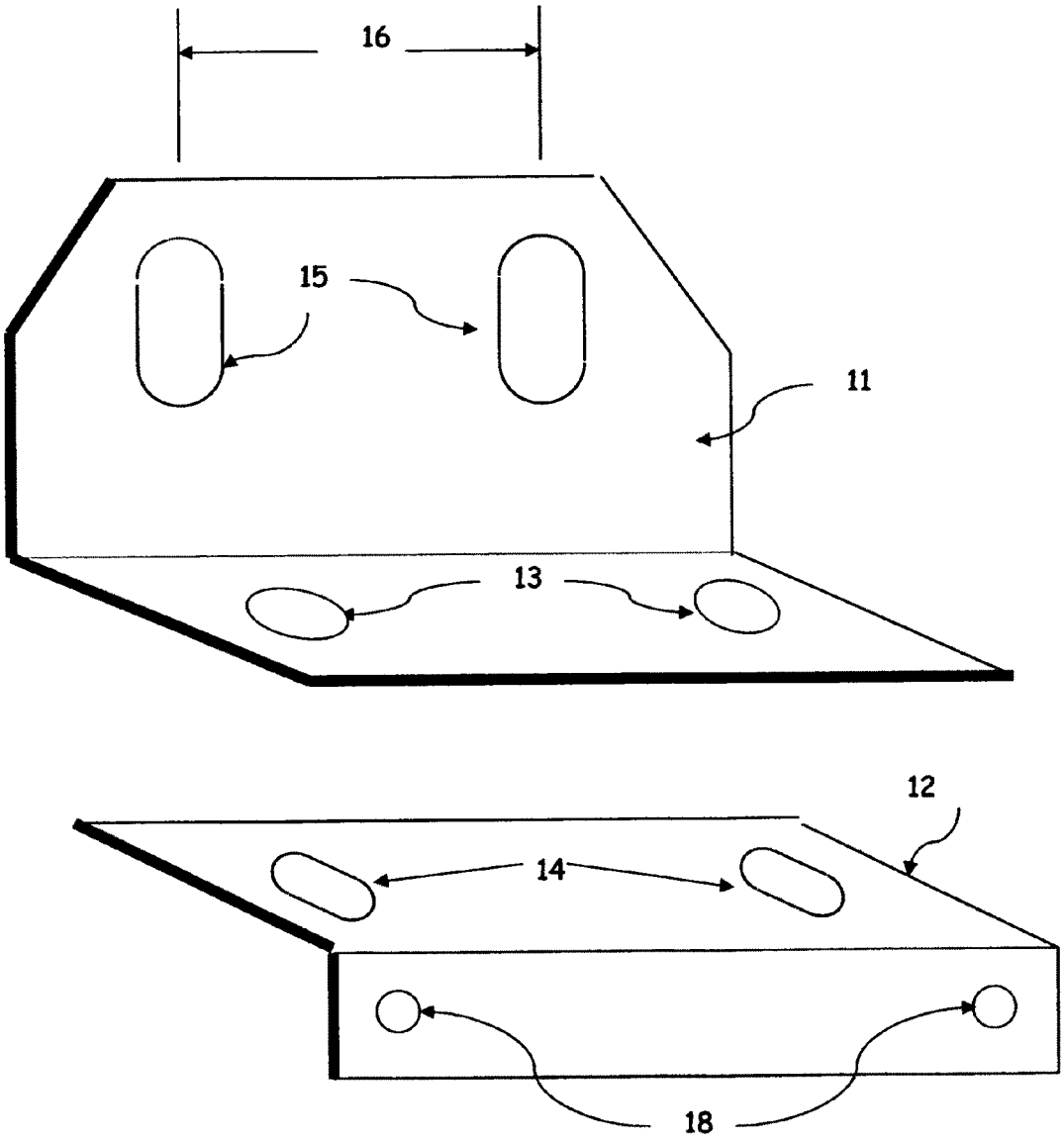
FIG. 4 shows the bracket set of this method. It consists of two pieces (brackets) of strong plastic or metal or other non-bending construction material. Each piece (bracket) is L-shaped with 2 holes and 2 slotted holes. The TOP bracket has the 2 slotted holes located to match existing screw locations on the existing bracket of the commercial automatic door system. These are slotted holes to allow for margin in locating the up-down position for the bracket. The other 2 holes of this bracket are for connection to the second (BOTTOM) bracket.
Figure 5:
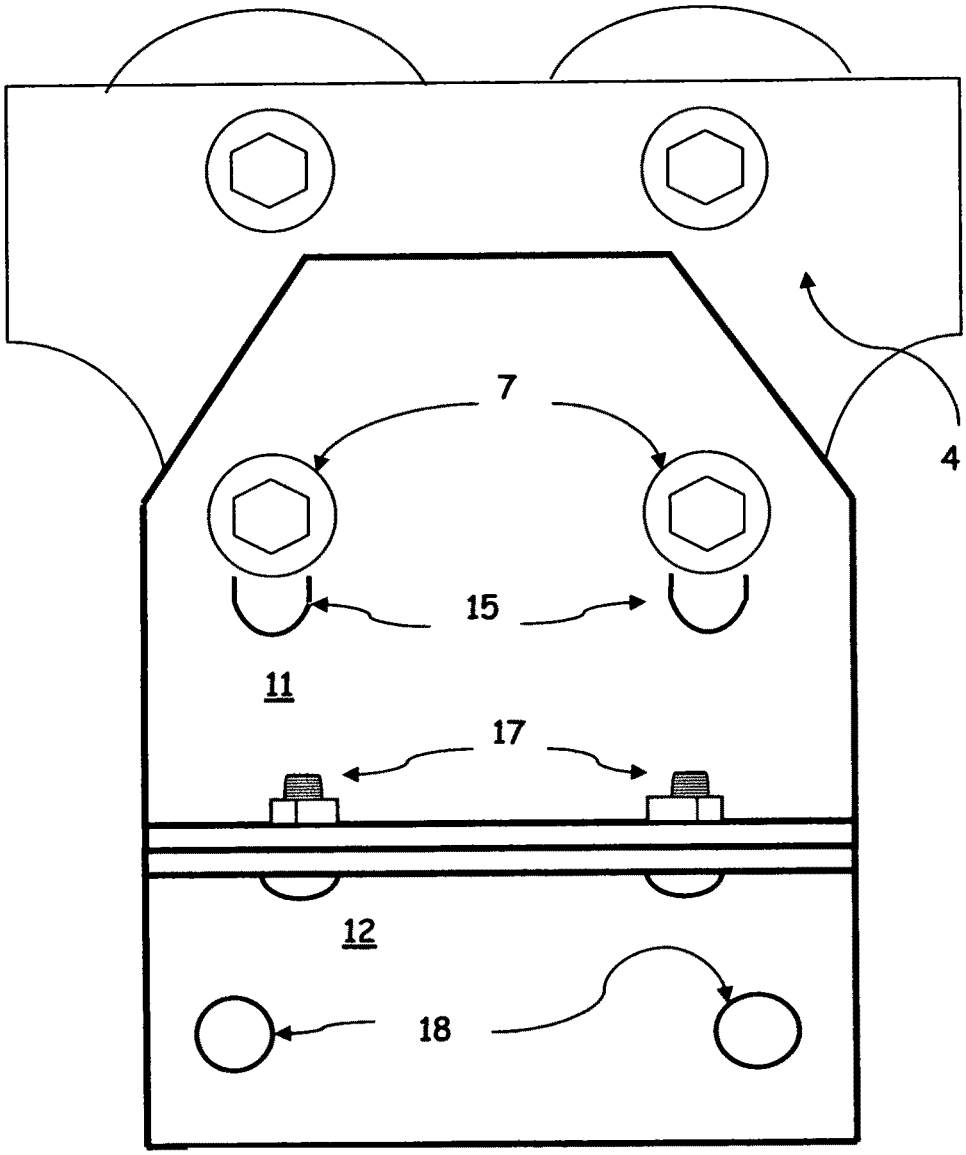

FIG. 5 shows the same front view of the same wheel carriage as in FIG. 3, except that the bracket which comes with the commercial automatic door unit has been replaced by the bracket system shown in FIG. 4. This shows how the bracket system has been designed to fit using existing screws of the wheel carriage and that it does not interfere with any other part of the wheel carriage.

Figure 2:
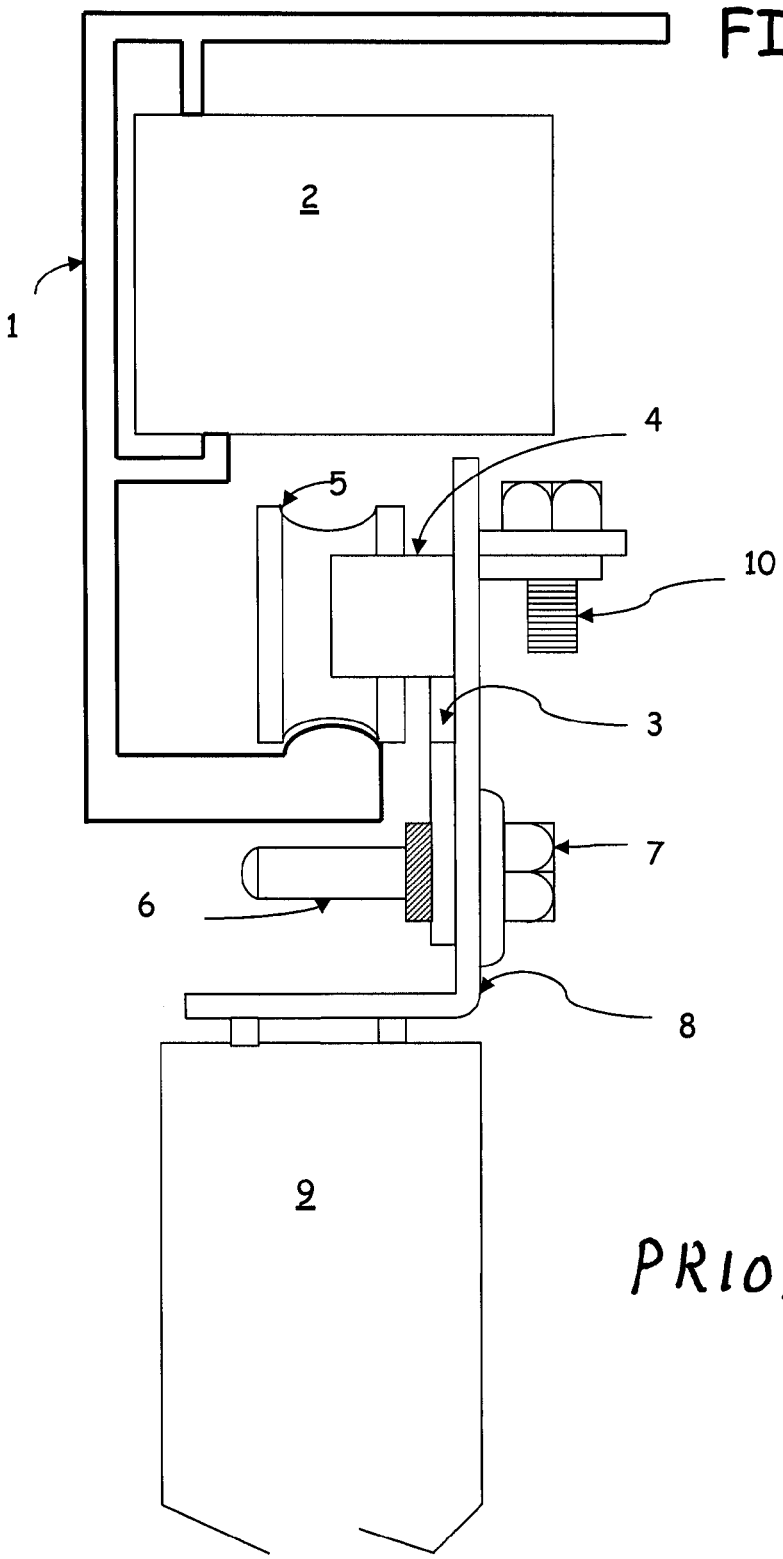
FIG. 2 PRIOR ART
FIG. 2 is a cross sectional view of how one kind of commercial hanging door track type automatic door system is normally installed in its normal (commercial) application. The glass door panel which is to be moved to open and close is suspended from the automatic door system. This door panel is held up via a bracket set attached to at least two wheel carriages. These wheel carriages travel along a track which is part of the automatic door system and are moved by a power belt or chain. The belt or chain is part of a motorized system which is controlled by a microprocessor which can receive signals from sensor units to open or close the door panels.
Figure 6:
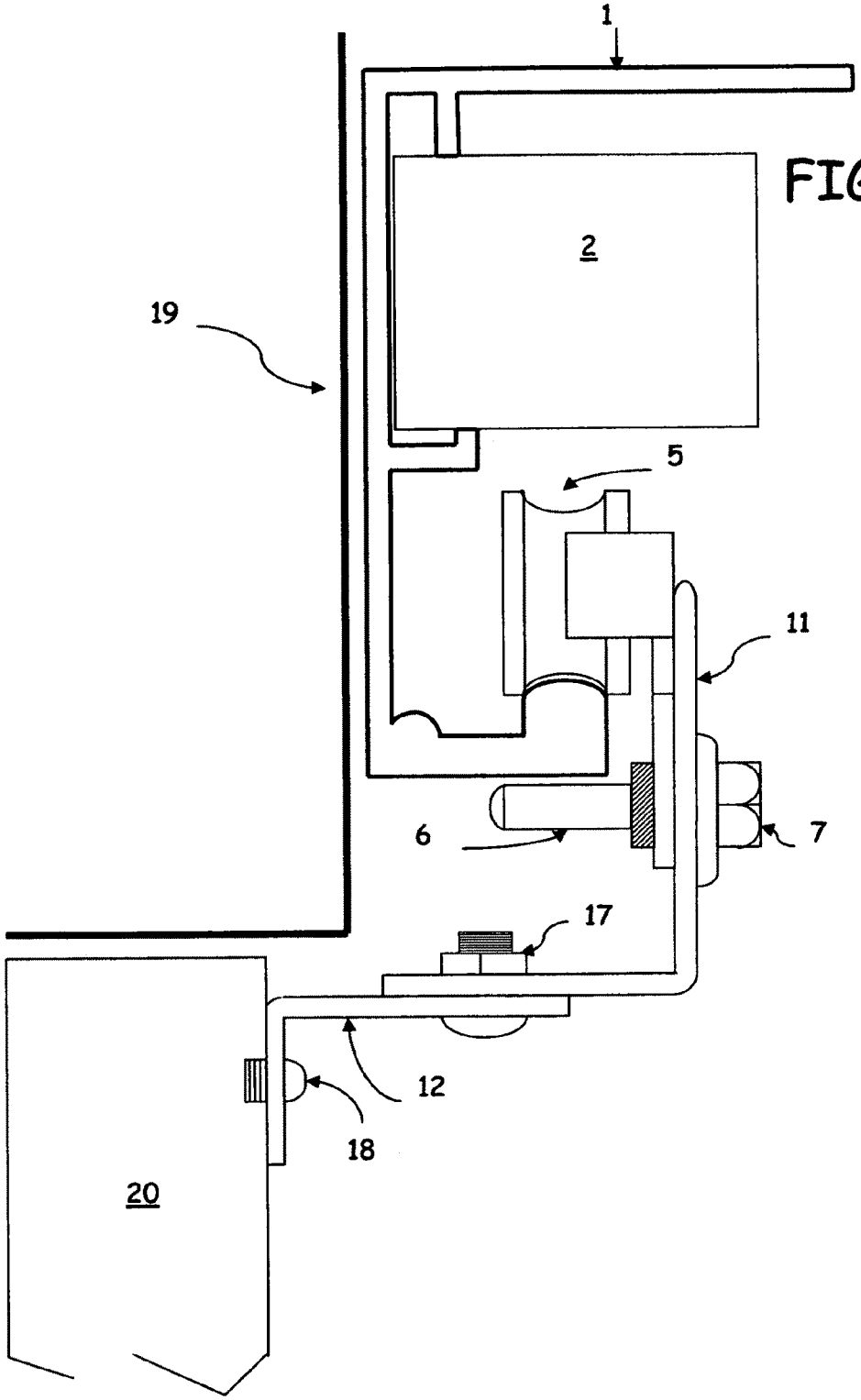

FIG. 6 is the cross sectional view of the same commercial track type automatic sliding door system of FIG. 2. However, this time the track unit is located against the wall (header) above an existing residential patio sliding door. This figure also shows this method's proper use of its bracket system of FIG. 4 and FIG. 5 to connect the wheel carriage to the top front panel of the residential patio door frame. FIG. 6 shows that the automatic door system power unit is no longer directly above the door panel. It is now no longer a part of the wall, but attached to the side of the wall.

Figure 7:
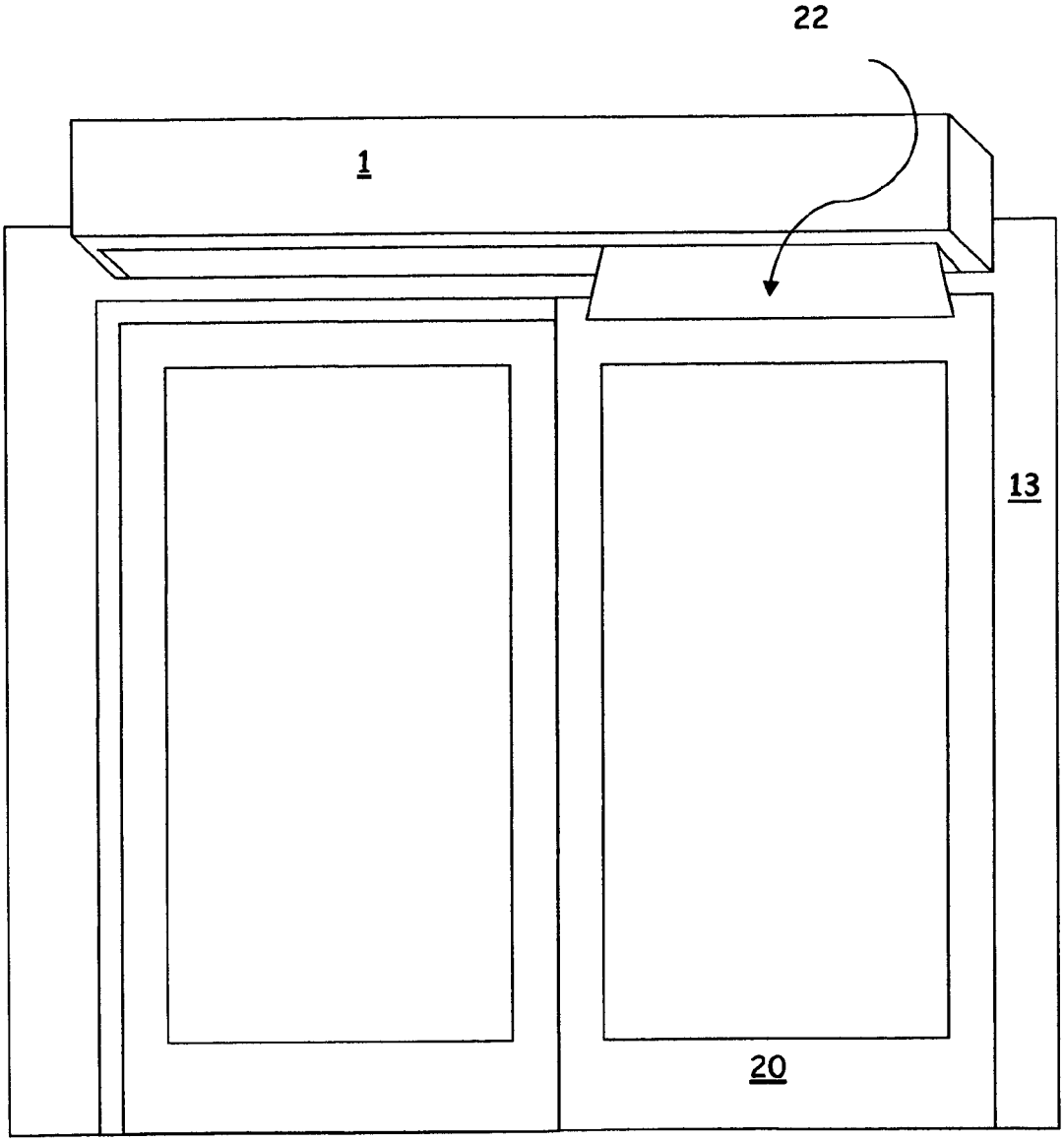

FIG. 7 shows how one could use one (1) large bracket system per door, but it must be attached to the automatic door system in two places; one at either end of the door.

Figure 8:
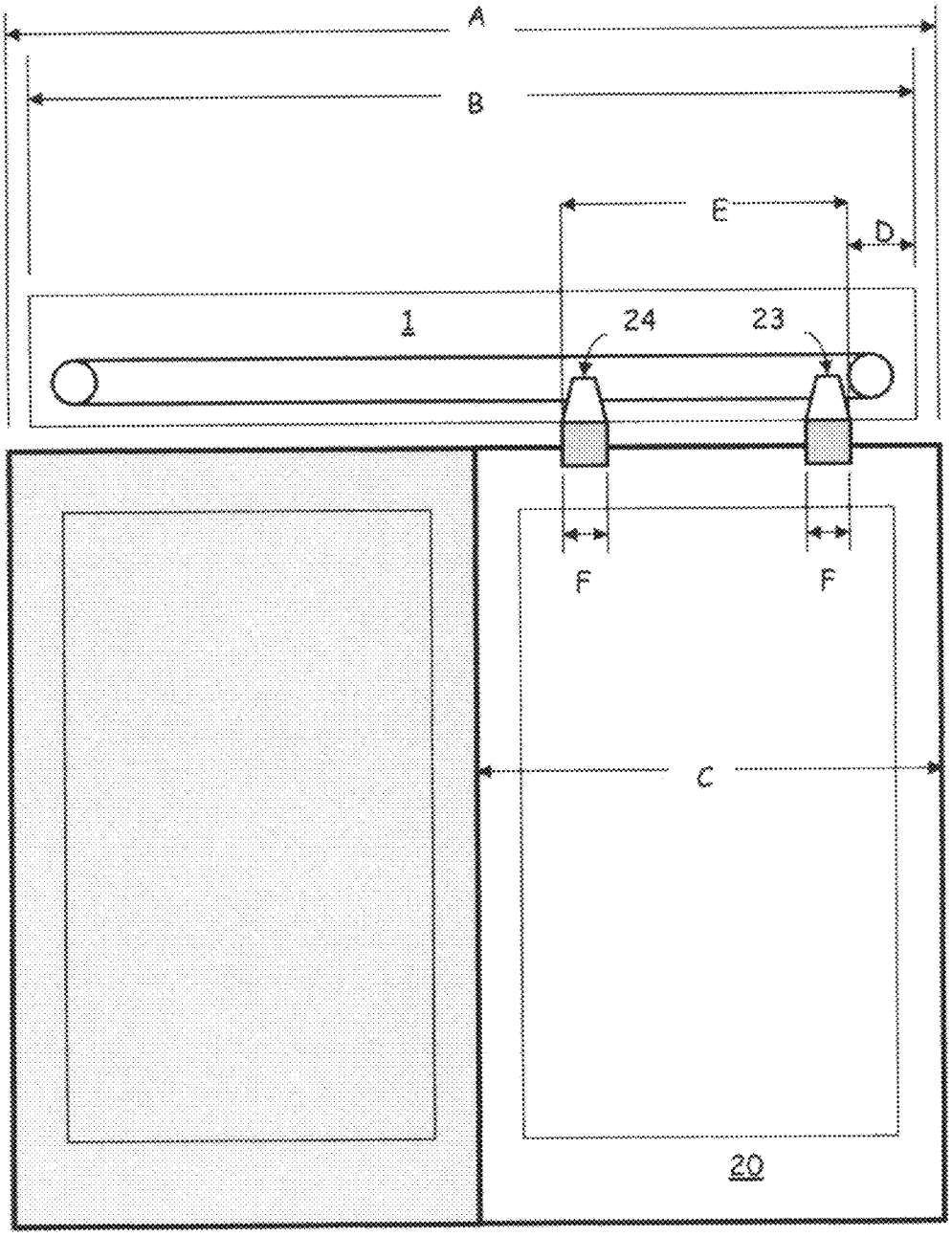

FIG. 8 shows the horizontal dimensions which are important in determining the appropriate commercial automatic door unit to use for a given range of residential patio sliding doors.

Figure 9:
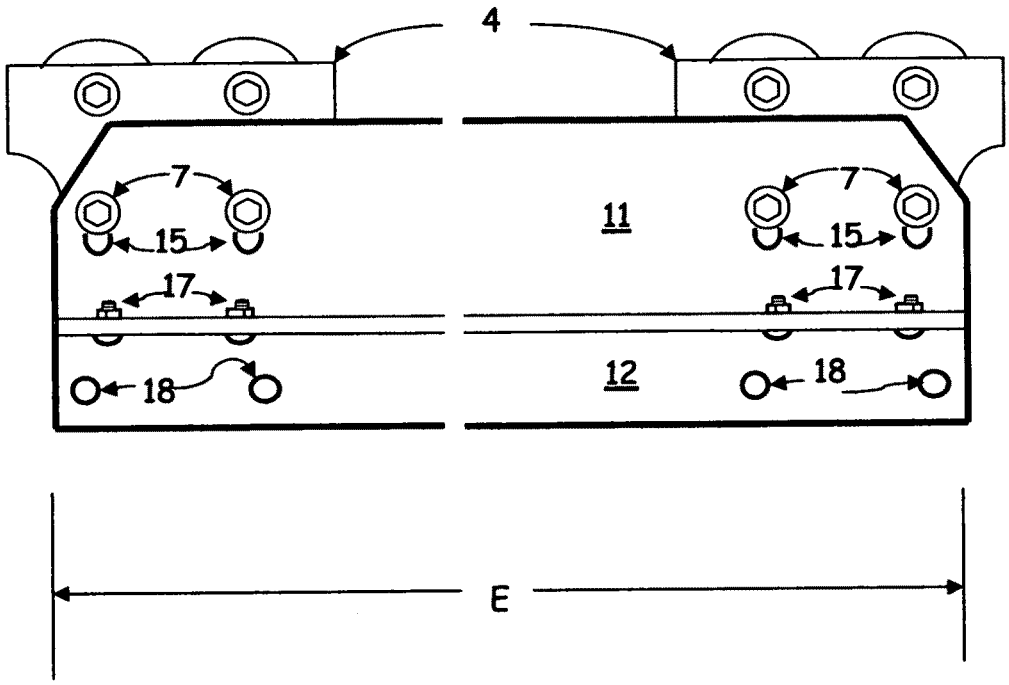

FIG. 9 shows how to determine the dimensions of the bracket system if one unifying bracket system of this method is used instead of two separate bracket systems.

Figure 10:
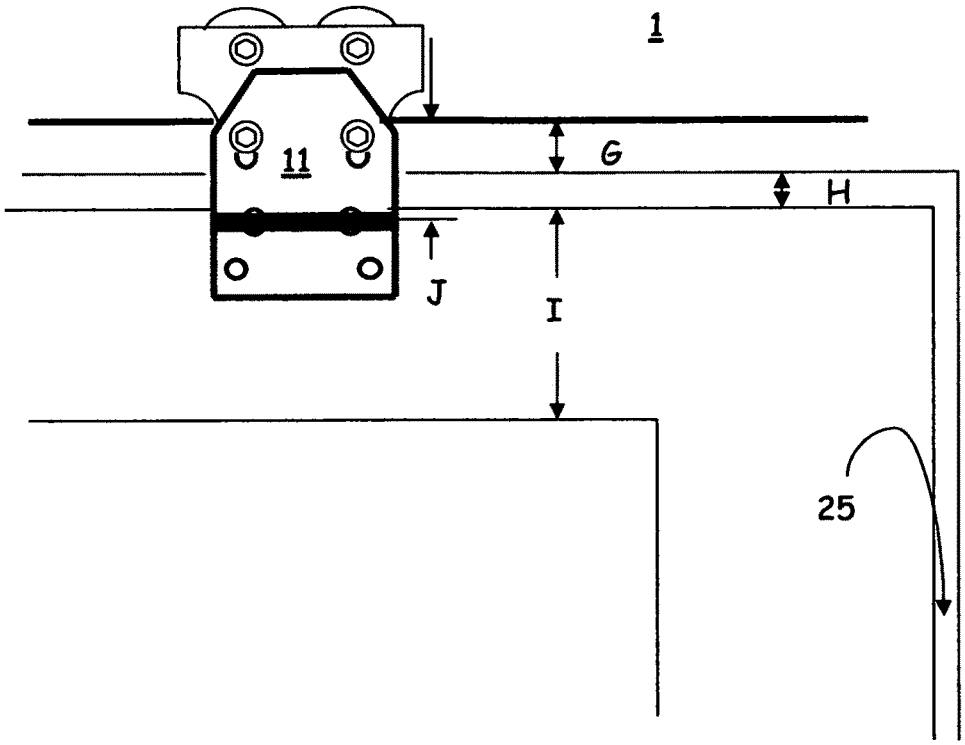

FIG. 10 shows the vertical dimensions which are important in the design of the bracket system of this method. This figure also shows how to determine the correct height above the door frame for installing the commercial automatic door track.

DETAILED DESCRIPTION

FIG. 2 is a simplified drawing of a cross section of an existing commercial automatic system for opening and closing sliding doors. The darkened area, 1, is the metal (aluminum) track. The upper portion, 2, of this track houses the motor, control system, and the power belt or chain. The bottom portion of the track has a rail upon which rides one or more wheel carriages, 3. A front view of a wheel carriage is shown in FIG. 3.

A wheel carriage, 3, consists of the wheel carriage frame, 4, to which are attached wheels, 5, which roll on top of the rail, and wheels, 6, which are located below the rail. The lower wheel, 6, is held against the rail by means of its axis adjustable screw, 7.

The wheel carriage, 3, also has a strong metal bracket, 8, which is L-shaped to allow a sliding door panel, 9, to be attached to it directly under the track, 1. Because these sliding doors are heavy and are hanging from the track system, a positioning screw, 10, is used to help hold the vertical position of the bracket, 8, against the carriage frame, 4.

FIG. 4 shows upper bracket, 11, and lower bracket, 12, which when screwed together in the relative position as shown in FIG. 3, results in a new bracket to replace the old bracket, 8. The bracket pieces are screwed together with machine screws, washers, and nuts, 17 (FIG. 5). One bracket is drilled with holes, 13, and the other has slots, 14, in order to make adjusts for the distance from the door panel face to the position of the wheel carriage. The slots, 15, of the upper bracket, are spaced, 16, such that the distance between their centers is equal to the distance between the centers of the two axis screws, 7, of the lower wheels, 6. Holes, 18, are provided for wood screws for attachment of the bracket to the upper face of a glass door panel or for machine screws for attachment to the thin metal frame of the upper portion of a screen door panel.

The brackets of FIG. 4 can be made of strong plastic or phenolic. They do not have to be of steel such as the bracket they are replacing because these brackets are not being used to hold up the doors. The brackets of FIG. 4 are shown facing into the door panel.

FIG. 5 shows a front view of the brackets, 11 and 12, assembled using screws, 17, and attached to the wheel carriage chassis, 4, via the lower wheel screws, 7. This figure is the view facing opposite of that in FIG. 4.

FIG. 6 is the new cross-sectional view of the commercial automatic track system with the track unit, 1, mounted to the header, 19, above an existing sliding patio door, 20. The brackets, 11 and 12, are connected together with screw, 17, attached to the wheel carriage via lower wheel screw, 7, and attached to the door panel, 20 via a wood screw through the hole in the bracket, 18.

Figure 1:
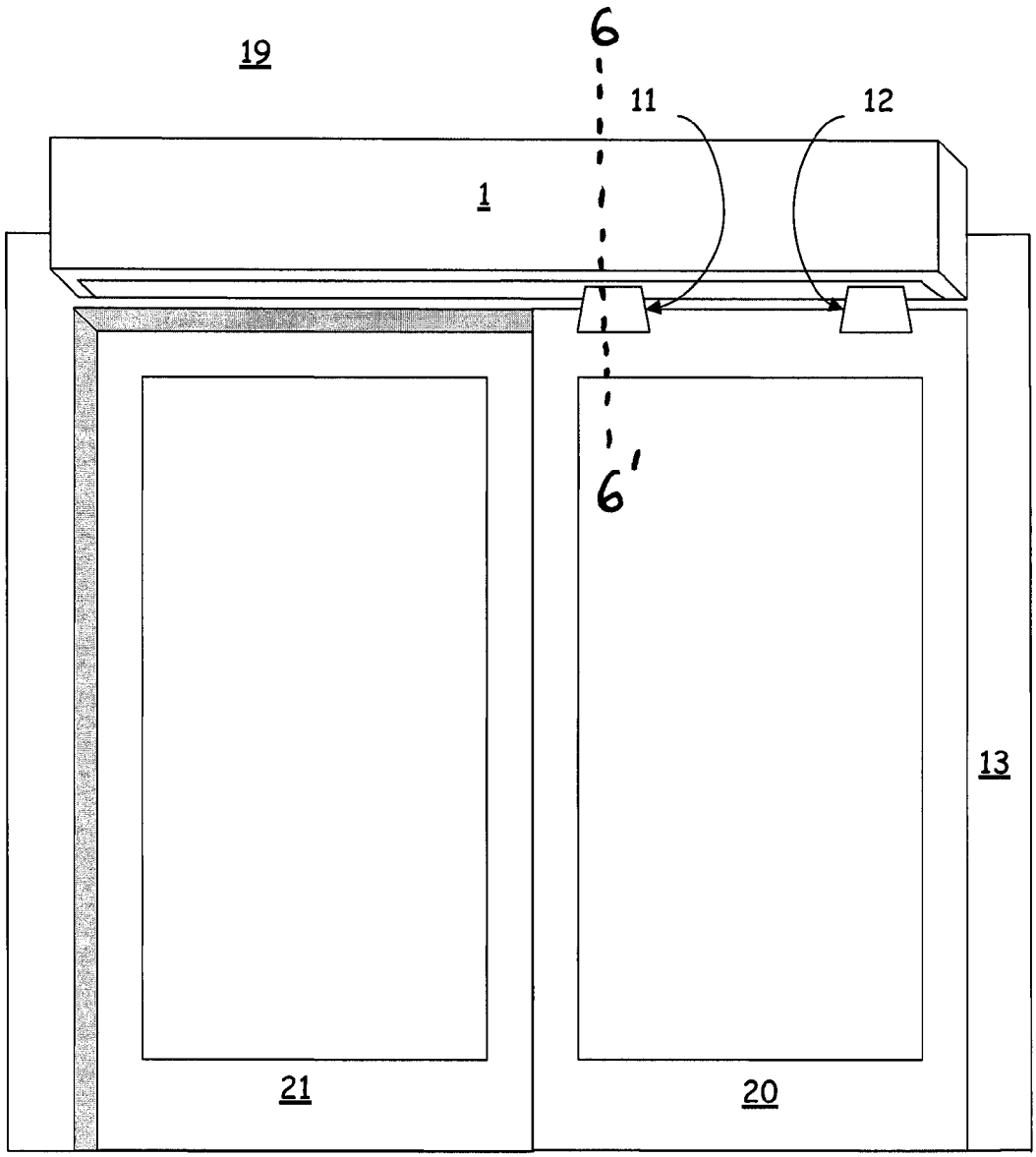
FIG. 1 shows the recommended use of two (2) sets of the bracket system of this method. These brackets are mounted close to the ends of the doors. This method provides mounting to the wheel carriage of the commercial automatic door system and that two (2) of these wheel carriages of the commercial automatic door system must be used per sliding door. However, only one of these wheel carriages needs to be directly connected to the drive belt. The other carriage can be just running on the track of the commercial automatic door system for stability.

FIG. 1 shows the commercial automatic door system, 1, which was originally designed to hold up and move heavy door panels in commercial property front entrances, fastened above an existing sliding patio door in a residence. The commercial auto door system track, 1, enclosed in its cover, is fastened directly to the wall (header, 19) directly above the existing (or newly installed) sliding patio door system. The patio door system consists of a frame which has sliding grooves running horizontally on the top and on the bottom of the frame. FIG. 1 shows a sliding patio door system with two door panels. One is a stationary glass panel, 21, in this case shown on the left of the door system as viewed from inside the house. The sliding glass panel, 20, is on the right. It moves to the left, in front of the stationary door panel, 21, in order to provide the opening on the right. FIG. 1 shows this sliding glass panel, 20, attached to two wheel carriages (hidden under the cover of the automatic door system, 1) via two separate bracket groups consisting of upper bracket 11 and lower bracket 12.

FIG. 7 shows the same residential patio sliding door system operated by the same commercial automatic door unit, 1. However, one long bracket set, 22, consisting of upper bracket 11 and lower bracket 12, is used to connect the two wheel carriages to the door frame, 20. In both FIGS. 6 and 7, the patio door decorative moldings, 13, were first removed before installing the auto unit, 1. In this manner, the auto door unit, 1, is assured of being mounted flush against the wall above the door. The decorative molding, 13, is then cut out, where necessary, and replaced around the patio door frame.

FIG. 8 shows how to determine the size requirements of the commercial automatic door system, the total bracket maximum width for a one bracket system, and the bracket locations for a two bracket system depending upon door size. A is the total patio door system width. B is the commercial auto door system enclosure length. C is the sliding door panel total width. D is the distance from the end of the right-most wheel carriage, 23, to the end of the commercial auto door system enclosure, 1, when the wheel carriage, 23 is at the end of its linear path and door panel, 20, is closed. E is the distance from the left side of the left-most wheel carriage, 24, to the right side of the right-most wheel carriage, 23. The goal is to have a strong, stable pushing system which has an acceptable appearance. It is also required to hold the door panel so that the door panel does not tilt or bend if it sticks inside the track. This last requirement is more important for light screen door panels.

The upper and lower bracket widths are shown here to be the same. The upper bracket width is determined by the width of the wheel carriage frame. It is best to keep the upper bracket width, F, no larger than the wheel carriage frame. It is best to keep distance D small so that a smaller automatic door system can be used. Making the width of the upper bracket larger than the wheel carriage frame will make the distance D larger. The lower bracket width is usually the same as the upper bracket width for better appearance and to have less bracket showing on the door panel.

The spacing, E, the distance from the left side of the left-most wheel carriage, 24, to the right side of the right-most wheel carriage, 23, is determined using the equation:

$$E=C-(A-B)-2D.$$

For a one bracket system, the wheel carriages are connected together with one bracket (consisting of upper and lower parts) and E becomes also the single bracket width. This equation is used to check that the automatic door system is wide enough to provide for complete opening and closing of the door, and also a good appearance for the spacing of the brackets attached to the sliding door.

FIG. 9 shows a one bracket system connecting the two wheel carriages together. The single bracket system, consisting of upper bracket 11 and lower bracket 12, is determined as above to obtain the value of E.

FIG. 10 shows how to determine the vertical dimension of the bracket assembly and the vertical placement of the track. This can be used for either a two bracket system or a single bracket system. G=the distance from the bottom of the track, 1, to the top of the patio sliding door system frame, 25. H=the door frame thickness. J=the space between the bottom of the track, 1, and the bottom end of the upper bracket. When installing the track, it is most important that the distance, J, allows for the horizontal portion of the bracket to be below the patio door upper frame. The dimension I, in FIG. 10, is distance to the glass or screen portion of the door panel. This is shown for reference. The correct resultant positioning is shown in FIG. 5.

The invention claimed is:

1. An apparatus for adapting a motorized device having a wheel carriage for translating a hanging door along a translation direction to translate a rail-guided door along said translation direction, said apparatus comprising: an upper bracket, said upper bracket having a vertical face for engaging the wheel carriage, said vertical face having two slots separated by a distance equal to a distance separating two wheels in said wheel carriage, and a horizontal face, and said horizontal face having two apertures; a lower bracket having a horizontal face having two slots separated by a distance equal to a distance separating said two apertures in said horizontal face of said upper bracket, and a vertical face, said vertical face having a pair of apertures for enabling said lower bracket to be fastened to said rail-guided door.

* * * * *